US009815307B2

(12) United States Patent
Mueller et al.

(10) Patent No.: US 9,815,307 B2
(45) Date of Patent: Nov. 14, 2017

(54) METHOD FOR AVOIDING COLLISIONS, FOR ADAPTING A SPACING AND FOR ACTUATOR-BASED LIFTING MOVEMENT IN AN INKJET PRINTING MACHINE

(71) Applicant: HEIDELBERGER DRUCKMASCHINEN AG, Heidelberg (DE)

(72) Inventors: Andreas Mueller, Heidelberg (DE); Jochen Renner, Edingen-Neckarhausen (DE); Matthias Zapf, Heidelberg (DE); Ralf Steinmetz, Bammental (DE); Michael Oestreicher, Eppelheim (DE); Burkhard Wolf, Dossenheim (DE); Manfred Haeussler, Karslruhe (DE); David Ehrbar, Walldorf (DE); Alexander Knabe, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 15/166,312

(22) Filed: May 27, 2016

(65) Prior Publication Data

US 2017/0072722 A1 Mar. 16, 2017

(30) Foreign Application Priority Data

Sep. 16, 2015 (DE) ..... 10 2015 217 688

(51) Int. Cl.

| | |
|---|---|
| ***B41J 25/304*** | (2006.01) |
| ***B41J 25/308*** | (2006.01) |
| ***B41J 2/01*** | (2006.01) |
| ***B41J 11/00*** | (2006.01) |

(Continued)

(52) U.S. Cl.

CPC ..... *B41J 25/308* (2013.01); *B41J 2/01* (2013.01); *B41J 11/0095* (2013.01); *B41J 13/223* (2013.01); *B41J 25/304* (2013.01); *B41J 2025/008* (2013.01)

(58) Field of Classification Search

CPC .... B41J 25/308; B41J 25/3088; B41J 25/312; B41J 2/02; B41J 2/04556; B41J 25/304

See application file for complete search history.

(56) References Cited

U.S. PATENT DOCUMENTS 5,366,301 A * 11/1994 Martin ..... B41J 11/005 347/8
8,579,286 B2 11/2013 Hirai et al.
9,160,892 B1 * 10/2015 Shelhart ..... H04N 1/605

(Continued)

FOREIGN PATENT DOCUMENTS

DE EP 0993957 A2 * 4/2000 ..... B41J 2/01
JP 2011126131 A 6/2011

*Primary Examiner* — Sharon A Polk

(74) *Attorney, Agent, or Firm* — Laurence A. Greenberg; Werner H. Stemer; Ralph E. Locher

(57) ABSTRACT

A method for avoiding collisions in a digital inkjet printing machine, a method and a device for actuator-based lifting movement of inkjet heads. A sensor/camera monitors the sheets as they travel towards the inkjet heads. In order to avoid collisions, the inkjet heads are raised and lowered again individually and in an oscillation-optimized manner when a defective sheet is detected. The machine does not need to be stopped in the event of defective sheets. Advantageously, rejects can thus be reduced and the performance of the machine can be exploited better.

13 Claims, 7 Drawing Sheets

(51) Int. Cl.
*B41J 13/22* (2006.01)
*B41J 25/00* (2006.01)

(56) References Cited

U.S. PATENT DOCUMENTS

| | | | | |
|---|---|---|---|---|
| 2006/0132522 | A1* | 6/2006 | Baker | B41J 25/308 347/14 |
| 2006/0275532 | A1 | 12/2006 | Dechert | |
| 2008/0238959 | A1 | 10/2008 | Kato et al. | |
| 2009/0284561 | A1 | 11/2009 | Fukui | |
| 2009/0303276 | A1* | 12/2009 | Van De Wynckel | B41J 3/4078 347/19 |
| 2011/0279507 | A1 | 11/2011 | Castillo et al. | |
| 2012/0218328 | A1 | 8/2012 | Hattori et al. | |
| 2013/0113862 | A1 | 5/2013 | Kemma et al. | |
| 2013/0307893 | A1 | 11/2013 | Suda et al. | |
| 2015/0116395 | A1 | 4/2015 | Schelmbauer | |

* cited by examiner

METHOD FOR AVOIDING COLLISIONS, FOR ADAPTING A SPACING AND FOR ACTUATOR-BASED LIFTING MOVEMENT IN AN INKJET PRINTING MACHINE

CROSS-REFERENCE TO RELATED APPLICATION

This application claims the priority, under 35 U.S.C. §119, of German patent application DE 10 2015 217 688.6, filed Sep. 16, 2015; the prior application is herewith incorporated by reference in its entirety.

BACKGROUND OF THE INVENTION

Field of the Invention

The invention relates to a method for avoiding collisions of sheets transported on a transport element with a plurality of inkjet heads fitted above the transport element for printing the sheets. The invention further relates to a method for actuator-based lifting movement and to a device for the actuator-based lifting movement of an inkjet head in order to change the spacing from a printing material transport path of printing materials.

In order to print sheets of paper, board and paperboard in small numbers or with individual printing motifs, the use of digital printing machines is known. When inkjet heads are used for printing the sheets, a respective sheet is moved through under the inkjet heads with minimum spacing by a transport system. Known as transport systems are circulating transport belts, for example implemented as suction belts, and rotating cylinders, so-called jetting cylinders, or circulating tablets, such as are described, for example, in U.S. Pat. No. 8,579,286 B2.

In machine concepts using cylinders, such as are described in patent application publication US 2009/0284561 A1, for example, a plurality of inkjet print heads spaced apart radially are arranged above a jetting cylinder, printing sheets moved past at a short distance from the print heads. A plurality of sheets can be attracted to a jetting cylinder by suction and transported simultaneously. In order to ensure a high printing quality and to avoid damage to the print heads, it is important that a respective sheet lies well on the jetting cylinder.

In addition, it is known to monitor the sheet run and to detect defective sheets or sheets lying defectively. In order to prevent damage to the highly sensitive printing nozzles of an inkjet head by turned-up corners, edges or creases, for example, the printing machine is usually stopped and the defective sheet is removed.

Such a printing machine is described in patent application publication US 2013/0307893 A1. If a defective sheet is detected by a sensor placed upstream of the inkjet heads, not only is the machine stopped but all the inkjet heads are also raised and therefore brought into a withdrawn position. The defective sheets can then be removed without difficulty by the machine operator.

An alternative solution is described in patent application publication US 2015/0116395 A1. In order in the digital web printing machine to avoid collisions of the printing material web with the inkjet heads in the event of a printing material web that is defective, the web run is lowered briefly. In digital sheet-fed printing machines, this solution variant does not represent an option, since the logistical attachment of the transport element located in the area of the inkjet heads to transport elements placed upstream and downstream, for example transfer cylinders, would no longer permit continuous transfer and transport of sheets in the event of being lowered.

The disadvantage with the known method for avoiding collisions in digital sheet-fed printing machines is the high outlay for the manual removal of the defective sheets and the immense impairment to the productivity of the machines because of extended stoppage times.

SUMMARY OF THE INVENTION

It is accordingly an object of the invention to provide a method for avoiding collisions which overcomes the above-mentioned and other disadvantages of the heretofore-known devices and methods of this general type and to provide for a process in which as few rejects as possible are produced and in which the productivity of the inkjet print heads is exploited in the best possible way.

A further object is to describe a method for the lifting movement of an inkjet head which can be used for the aforementioned method and in which fault sources resulting from the lifting movement are reduced.

A further object is to devise a device in which printing defects on account of changes in the sheet thickness or on account of printing material thickness fluctuations within a sheet are avoided, as few rejects as possible are produced and in which the productivity of the inkjet print heads is exploited in the best possible way.

With the foregoing and other objects in view there is provided, in accordance with the invention, a method for avoiding collisions of sheets with inkjet heads in a printing machine, the method comprising:

transporting sheets on a transport element (e.g., an impression cylinder, jetting cylinder) past a plurality of inkjet heads disposed above the transport element for printing the sheets;

monitoring the position of a respective sheet upstream of the inkjet heads in a transport direction;

evaluating a measured result from the position monitoring for detecting a defective sheet; and when a defective sheet is detected, raising a respective inkjet head before the defective sheet reaches the inkjet head.

The first above-mentioned object is achieved by a method for avoiding collisions of sheets, in particular those made of paper, board and plastic, transported on a transport element, with a plurality of inkjet heads fitted above the transport element for printing the sheets, said method comprising the following steps: Permanent monitoring of the position of a respective sheet and the edges and corners thereof—seen in the transport direction—is carried out upstream of the inkjet heads, in particular by using at least one sensor or a camera. An evaluation of the measured result from the position monitoring is carried out by a machine control system for the detection of defective sheets, for example sheets having dog-ears, creases, etc. Depending on the evaluation of the measured result, if necessary a respective inkjet head is raised in each case immediately before a defective sheet reaches this inkjet head, in particular by using an actuator assigned to the inkjet head. In other words, directly before the defective sheet reaches the inkjet head and could possibly damage or even destroy the latter, the inkjet head is raised into a distanced protective position. This means, first of all the first inkjet head, then the second inkjet head, etc, is raised, that is to say the spacing of the respective inkjet head from the transport element or from the sheet is increased. Not all the inkjet heads are raised jointly at once.

Such a method, in which the inkjet heads are raised sequentially, has the advantage that the digital printing machine does not have to be stopped in the event of defective sheets, and its productivity is not unnecessarily reduced on account of stoppage times. In addition, the main drive of the transport element does not have to be designed for very fast stopping either, and in principle it is possible for higher speeds to be run.

In a particularly advantageous and therefore preferred development of the method for avoiding collisions, in a further additional step, immediately after a defective sheet has passed a respective inkjet head, in each case said inkjet head is lowered back into a near printing position. This means that, one after another, the first inkjet head, then the second inkjet head, etc, is each moved back into the original position. The lifting and lowering sequence may be envisioned as a "wave" at a sporting event.

This has the advantage that the quantity of rejects on account of defective sheets is reduced, since, as a result of the sequential raising and lowering of the individual inkjet heads, only the actually defective sheet is not printed; the preceding and also the following sheet, on the other hand, can be printed.

A further advantage results if, following the digital printing station, a varnishing unit is used. On account of the continuous sheet stream, which means that since one sheet follows another and it is possible for one of the sheets also to be a defective sheet, the varnishing unit can be operated continuously, therefore does not have to withdraw from the printing, and thus no further lost sheets are caused by switching the varnishing unit on and off.

In accordance with an alternative embodiment of the method, which has the same advantages, the inkjet head is not lowered as soon as the defective sheet has passed this inkjet head. Instead, the lowering movement is already begun while the defective sheet is still located underneath this inkjet head. This has the additional advantage that the inkjet head can be lowered more slowly and with lower accelerations and, nevertheless, is again located in its lower printing position in good time. For this purpose, it is necessary to raise the inkjet head higher than the defect of the defective sheet actually requires. In other words, a greater time window for the lowering movement is achieved in that a greater travel is covered during the raising action.

In an advantageous development of the method according to the invention, in the second step, a determination, in particular also a classification, of defect sizes is carried out and, depending on the defect size determined, in the following step the travel (i.e., the stroke, the amplitude) for raising a respective inkjet head is predefined by a machine control system. This has the advantage that, in the case of only small defects, only small lifting movements of the inkjet heads are also carried out; in the case of large defects, on the other hand, large lifting movements are required, and these are also carried out. If, according to the method variant described directly above, the lowering movement has already begun early, this is likewise taken into account in this second method step. In the case in which the determination of the defect sizes results in the defect size lying above a predefined maximum permissible limiting value, then, instead of the sequential raising of the inkjet head, immediate raising of all the inkjet heads by a maximum possible travel in the time that is available, that is to say the greatest possible travel, is triggered, by which means additional security against destruction of the inkjet heads is achieved.

In a development of the method, in order to raise and lower a respective inkjet head, in each case an actuator with a control connection to the machine control system and assigned to the inkjet head is provided, for example an electric motor or a piezo actuator. It is particularly advantageous if the actuator is implemented as a servomotor and is driven by a machine control system by means of an oscillation-optimized control profile; this means that a control profile is stored in the machine control system and, for example, can be applied on the basis of the defect size determined. The raising and lowering can in particular be carried out in accordance with the method for actuator-based lifting movement described in more detail below.

In accordance with an refined feature of the invention, the transport element is implemented as a sheet-carrying cylinder, as a so-called jetting cylinder, having a plurality of sheet support surfaces and channels arranged between the sheet support surfaces. According to the invention, respective raising and lowering of the respective inkjet head is carried out while a channel adjoining a defective sheet is passing the inkjet head. In other words: during a first channel passage, the inkjet head is raised, during the next channel passage the inkjet head is lowered again. Thus, the following sheet can already be printed again and the quantity of rejects is minimized.

In an alternative embodiment, the transport element is implemented as a transport table, what is known as a tablet. The sheets are moved through under the inkjet heads by circulating tablets. The raising and lowering of the heads can be done here while a gap between the tablets is passing the heads.

If a first defective sheet is followed by a further defective sheet, then the lowering movement of the inkjet head into its original printing position is omitted and a respective inkjet head remains in its protective position until a following fault-free sheet follows.

The defective sheets can be removed from the material flow before the sheets are stacked and/or delivered. For this purpose, an ejector module is provided in a deliverer of a digital printing machine, for example a diverter or an ejector drum.

With the above and other objects in view there is also provided, in accordance with the invention, a method for actuator-based lifting movement of an inkjet head, which is particularly suitable for use in the context of the above-described methods. The lifting method comprises:

providing an actuator assigned to the inkjet head and a machine control system for activating the actuator;

implementing an oscillation-optimized and inkjet-printing-optimized movement profile, in order to limit oscillations of the inkjet head and to limit pressure fluctuations in the ink supply of the inkjet head, wherein a control profile is stored in the machine control system; and selectively lifting the inkjet head by activating the actuator assigned to the inkjet head with the machine control system in accordance with the control profile.

In other words, the respective inkjet head is moved with an oscillation-optimized and inkjet-printing-optimized movement profile in order to limit oscillations of the inkjet head and to limit pressure fluctuations in the ink supply of the inkjet head. The control profile is stored in a machine control system and, by means of the machine control system, an actuator assigned to the inkjet head can be activated with the control profile and the actuator moves the inkjet head in accordance with the movement profile.

In accordance with an advantageous feature of the invention, a family of control profiles for a family of movement profiles can be stored in a memory of the machine control system. Thus, for example, a specific size of defect can be assigned a specific movement profile and therefore control profile. In general terms, different movement profiles can thus be provided for different travels. It is particularly advantageous if a respective movement profile maintains defined maximum acceleration limiting values.

An advantageous movement profile is a jerk-limited movement, which can be implemented as an acceleration trapezoid.

With the above and other objects in view there is also provided, in accordance with the invention, a device for actuator-based lifting movement of an inkjet head in order to change the spacing of the inkjet head from a printing material transport path of printing materials. The novel device comprises:

an actuator;

a mechanism for converting a rotational drive movement of the actuator into a translational movement of the inkjet head; and a compensation system for compensating for a weight of the inkjet head and for bracing the inkjet head against a machine frame of the device.

That is, there is also provided a device for the actuator-based lifting movement of an inkjet head in order to change the spacing of the inkjet head from a printing material transport path. Sheet or web printing materials are moved through underneath the inkjet head on the printing material transport path and can be printed in the process. The device has an actuator, a mechanism for converting a rotational drive movement of the actuator into a translational movement of the inkjet head, and a compensation system for compensating for the weight of the inkjet head, for example by using a compensation weight. The compensation system in an advantageous embodiment can be implemented as a spring system, which braces the inkjet head against a machine frame of the device. Such a device advantageously achieves the situation in which, in the case of a drive error or defect or a power failure, no undesired movement of the inkjet head takes place, neither raising nor lowering. Here, the spring system compensates for the weight of the inkjet head such that the mechanical friction of the actuator, i.e. the self-locking effect thereof, is sufficient in any position to prevent an undesired movement of the inkjet head. Such an undesired movement would be lowering in printing operation or raising from the capping position (in which the nozzles are protected against drying out) outside the operating times.

In accordance with an advantageous feature of the invention, the mechanism is implemented as a coupler mechanism with coupler, lever and drive shaft. This coupler mechanism has the advantage that a lowest possible position of the inkjet head, which can never be undershot, is defined mechanically.

In accordance with a concomitant feature of the invention, the spring system has at least one tension spring or at least one compression spring. In addition, the spring system can have a setting device for adapting the spring tension.

While the invention is described herein with reference to a sheet-fed system, it is also possible, in principle, to implement the same in digital web-fed printing machines. Instead of the sheet run, in this case the web run is monitored, and the web is understood as a "sheet."

Other features which are considered as characteristic for the invention are set forth in the appended claims.

Although the invention is illustrated and described herein as embodied in a method for avoiding collisions, for adapting spacing and for actuator-based lifting movement, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
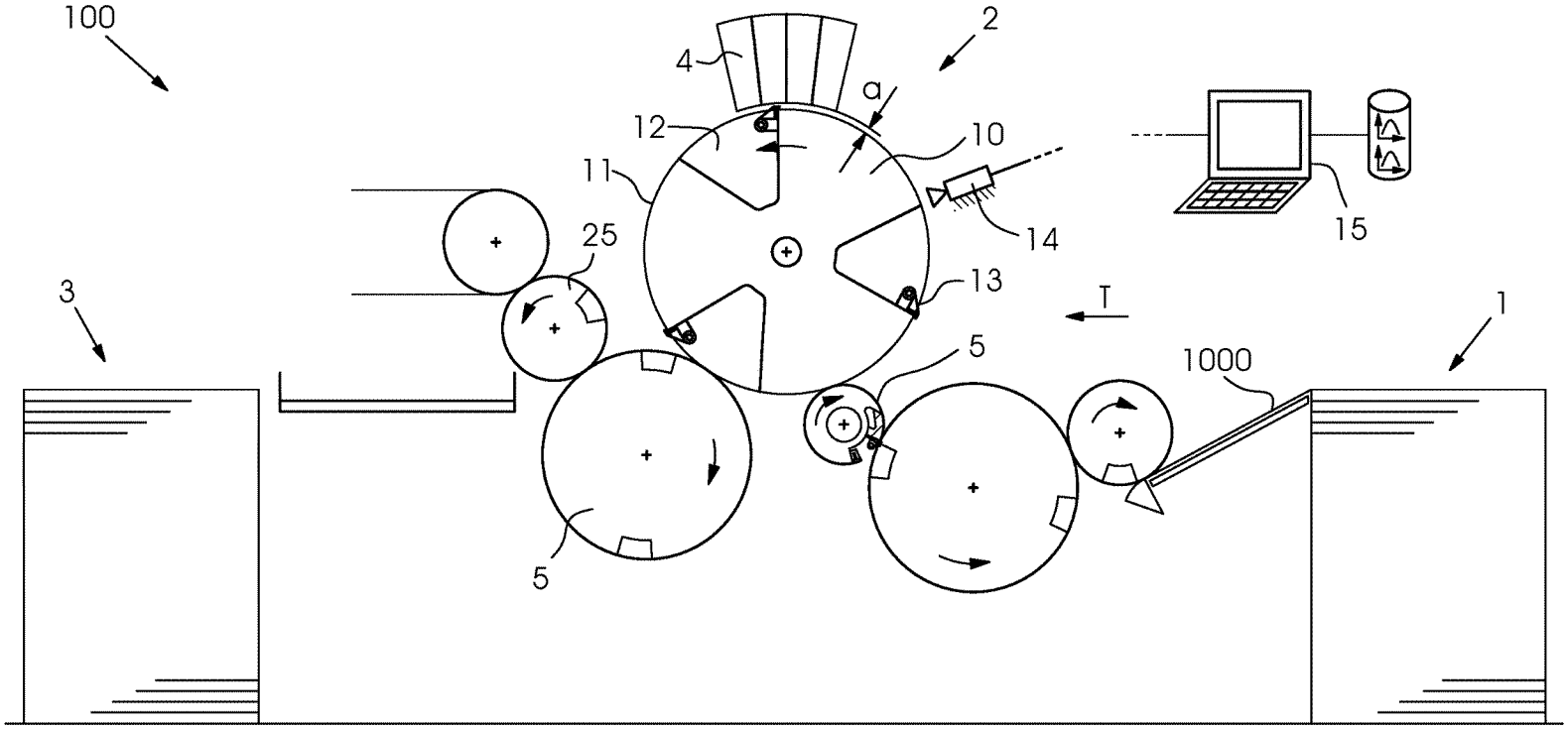
FIG. 1 is a schematic view of a digital printing machine for carrying out the method according to the invention.

Referring now to the figures of the drawing in detail and first, particularly, to FIG. 1 thereof, there is shown a sheet-fed printing machine 100, which is implemented as a digital printing machine. A respective sheet 1000, coming from a feeder 1, is transported in the transport direction T through a printing unit 2 to a delivery or deliverer 3. The transport of the sheet 1000 is primarily carried out by means of cylinders, specifically transfer cylinders 5 and an impression cylinder 10. Arranged above the impression cylinder 10, at a spacing distance a from the impression cylinder 10 are inkjet heads 4. The inkjet heads 4 print a sheet 1000 as it is being moved past at a short distance by the impression cylinder 10. The impression cylinder 10 is therefore also referred to as a jetting cylinder.

In the illustrated embodiment, the impression cylinder 10 has three sheet-holding regions 11, which are each separated from one another by a channel 12. The sheets 1000 are held on the sheet-holding regions 11 by way of grippers 13.

In order to drive the printing machine 100, a machine control system 15 with an operator interface and a memory is provided. Viewed in the transport direction T, upstream of the inkjet heads 4 there is arranged a camera or alternatively a sensor 14, which is used for the permanent monitoring of the sheets 1000. It is possible to monitor the sheet run or the sheet thickness d. The camera or sensor 14 have a data transmission and transfer connection to the machine control system 15. Here, the camera or sensor 14 must be arranged far enough upstream of the inkjet heads 4 in order that, even in the event of a defect 1001 (cf. FIG. 2) at the sheet trailing edge, a collision of the sheet 1000 and the inkjet heads 4 can still be avoided.

Figure 2:
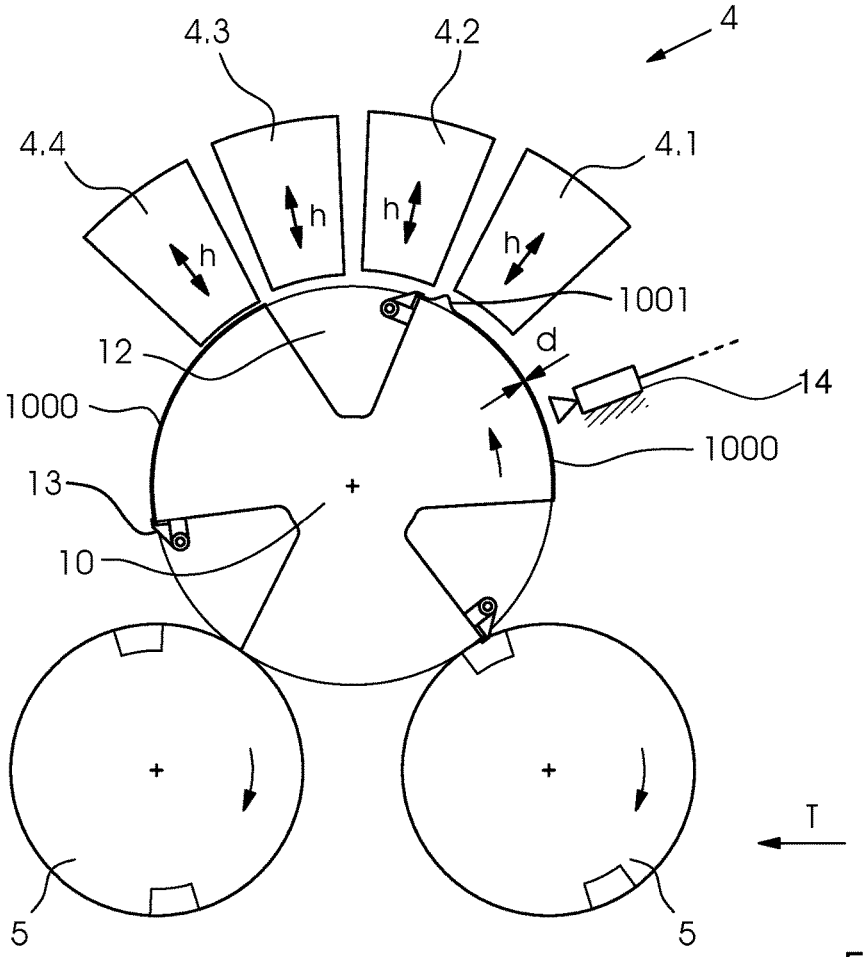
FIG. 2 shows a printing station with print heads that can be raised individually.

FIG. 2 shows a jetting cylinder 10 with inkjet heads 4 in a detailed illustration and an instantaneous recording. Arranged spaced apart radially from the jetting cylinder 10 are four inkjet heads 4.1, 4.2, 4.3 and 4.4, which are all able to execute a lifting movement h. Viewed in the transport direction T, upstream of the inkjet heads 4 there is arranged a sensor 14 for monitoring the sheet run. The sensor 14 has a data transfer connection to the machine control system 15 (illustrated in FIG. 1). By means of the sensor 14, it is possible to check whether sheets 1000 are defective, for example have dog-ears, edges sticking up or creases, whether the sheets 1000 are resting correctly on the jetting cylinder 10. It is also possible to monitor the thickness d of the sheets 1000. If a defect on the sheet, i.e. a defective sheet, is identified by the sensor 14, then the inkjet heads 4.1, 4.2, 4.3 and 4.4 are raised one after another by actuators (not shown here) driven by the machine control system 15, to be specific immediately before the sheet 1000 having a defect 1001 reaches the respective inkjet head 4.1, 4.2, 4.3 and 4.4. The raising of the inkjet heads 4 is indicated by the double arrow h. In the instantaneous recording shown in FIG. 2, the inkjet heads 4.1, 4.2 and 4.3 have already been raised. The first inkjet head 4.1 has already reached its protective position, the further inkjet heads 4.2 and 4.3 are still being raised further into this position. Underneath the fourth inkjet head 4.4 there is still a preceding sheet 1000 which is still being finally printed by the inkjet head 4.4. Only subsequently, as soon as the channel 12 of the jetting cylinder 10 passes the inkjet head 4.4, is this fourth inkjet head 4.4 also raised. In other words, the raising of the inkjet heads 4 is done separately and sequentially for each individual head 4.1, 4.2, 4.3 and 4.4. Each head 4 is raised exactly when the channel 12 passes the inkjet head 4 or "moves through under the latter". As soon as the defective sheet 1000 with defect 1001 has been moved through under a respective head 4.1, 4.2, 4.3 and 4.4, which means that when a following channel 12 adjoining the defective sheet 1001 passes the inkjet heads 4, the inkjet heads 4.1, 4.2, 4.3 and 4.4 are lowered again one after another and moved into their printing position. Therefore, a next following sheet 1000 can again be printed normally.

If, for a following sheet 1000, a defect 1001 is likewise detected by the sensor 14, then the inkjet heads 4 remain in their protective position and are only lowered into the printing position again later.

If the result of the evaluation of the measured result from the sensor 14 in the machine control system 15 is that the defect 1001 has a size which is above a predefined limiting value, then immediately after the detection all the inkjet heads can be raised immediately and moved by the greatest possible movement travel. As a result, although the quantity of rejects is increased, since the preceding sheet 1000 can no longer be finally printed and the inkjet heads 4 cannot be lowered into the printing position again quickly enough for a following defect-free sheet 1000, in this way serious damage to the inkjet heads 4 can be avoided. Such raising of the inkjet heads 4 can also be initiated by the machine control system 15 in the case of an emergency stop of the digital printing machine 100.

For the regular sequential raising and lowering of the inkjet head 4.1, 4.2, 4.3 and 4.4 one after another, a lifting movement of 15 mm, for example, can be provided. For the common raising of all the inkjet heads 4 in the event of particularly large defects 1001, a lifting movement h of 50 mm and more, for example, can be provided.

Figure 3:
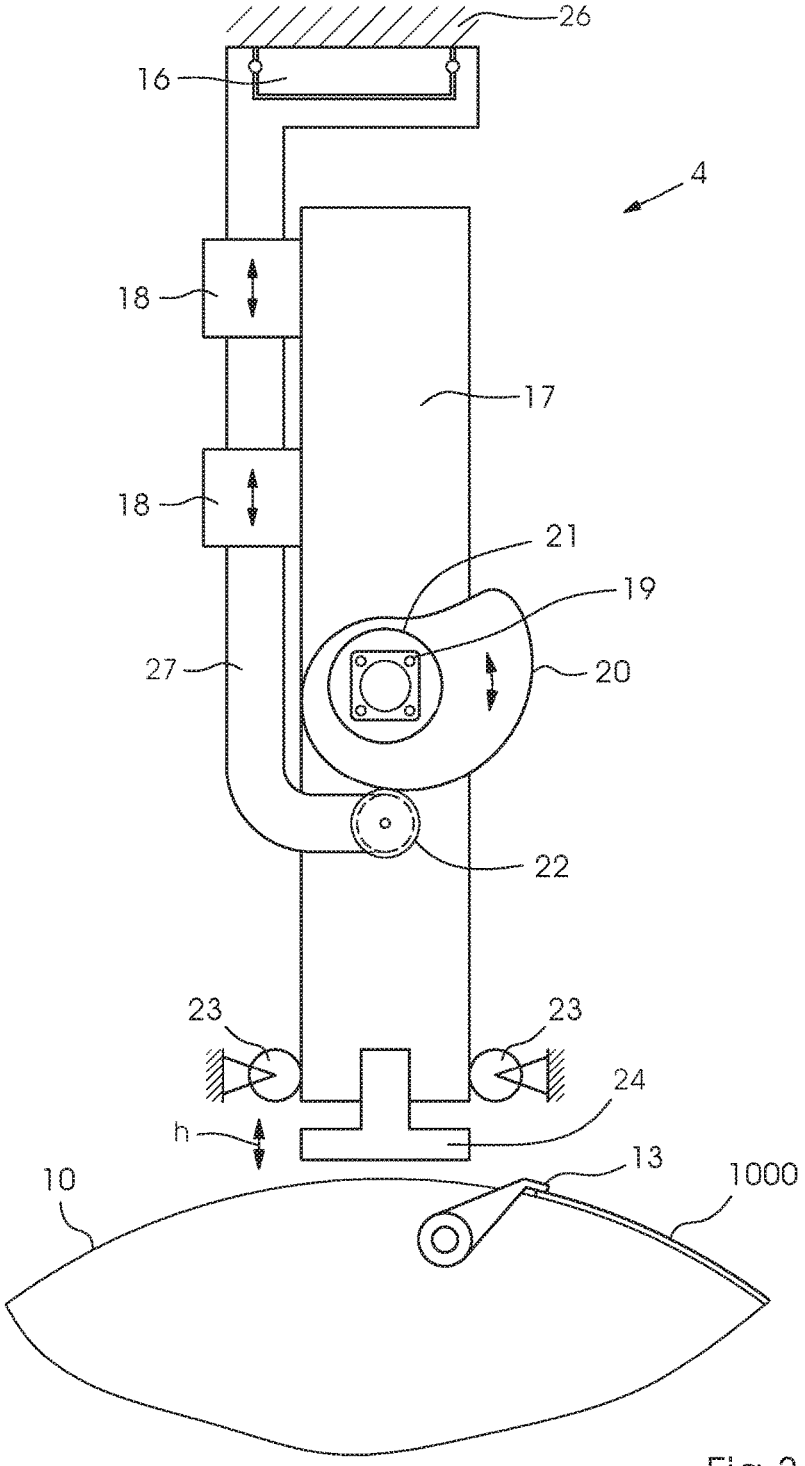
FIG. 3 illustrates the lifting movement of a print head.

Referring now to FIG. 3, there is illustrated the mounting of an inkjet head 4 in detail. It is possible to see how the lifting movement h of the print head 4 is implemented. A respective inkjet head 4 can be displaced at right angles to the transport direction T in a horizontal linear guide 16, in order to be able to move the inkjet head 4 laterally into a maintenance position. This can be done manually or by means of a (non-illustrated) drive. The inkjet head 4 has an integrated print bar 17 which, in addition to the nozzle bar 24, amongst other things comprises supply modules, such as filters and pressure compensators, not illustrated. The integrated print bar 17 is mounted on a linear guide 18 such that it can be displaced radially with respect to the jetting cylinder 10. The displacement along this linear guide 18, which corresponds to the lifting movement h in order to change the spacing of the inkjet head 4 from the jetting cylinder 10 and from the sheet 1000, is implemented by a drive unit 19, 20, 21, 22. Mounted on the integrated print bar 17 is a drive shaft 21 which is driven by a servomotor 19. At the two ends of the drive shaft 21, that is to say at the drive-side and the operator-side end of the drive shaft 21, cam disks 20 are seated on the drive shaft 21 and can be rotated by the shaft 21 by means of the drive 19. The cam disks 20 are in direct contact with a cam roller 22, which is fitted to the linear guide 18. By means of the rotation of the drive shaft 21 and therefore of the cam disks 20, the integrated print bar 17 can be raised and lowered relative to the linear guide 18 by using its cam rollers 22. For this purpose, the servomotor 19 has a data transfer connection to a machine control system 15, not illustrated here. In the memory of the machine control system 15, it is possible to store control profiles which impress a desired movement profile on the integrated print bar 17 and which are optimized with respect to oscillations of the inkjet head 4 and with respect to pressure fluctuations of the ink supply (not illustrated). The power supply of the servomotor 19 is implemented by a drag chain, not illustrated, which also comprises the activation lines of the nozzle bar 24 and the ink supply.

In order to guide the integrated print bar 17 accurately in its lower region and therefore to make the same independent of the exact angular position of the flexibility of the upper linear guides 16 and 18, supporting rollers 23 are provided, which are firmly connected to the side wall, which means the frame of the sheet-fed printing machine 100. The side surfaces of the integrated print bar 17, which are in contact with the supporting rollers 23, can have appropriately machined contact surfaces. The supporting rollers 23 arranged on one side of the integrated print bar 17 can also be of sprung design. Depending on the arrangement of the supporting rollers 23, it may also be sufficient to arrange the supporting rollers 23 only on one side of the integrated print bar 17. During the sequential raising and lowering of the inkjet head 4 with an only small lifting movement h of, for example, 15 to 20 mm, the supporting rollers 23 remain in permanent contact with the integrated print bar 17 and guide the latter. If the inkjet head 4 is raised a great deal in order to avoid a collision on account of a large defect 1001, which means it executes a large lifting movement h of 50 mm, for example, then the supporting rollers 23 lose contact with the integrated print bar 17 and, during the subsequent lowering and "threading" of the integrated print bar 17, the lowering speed must if necessary be reduced, so that excessively high excitation of oscillations of the inkjet head 4 does not occur. Such a speed reduction can be depicted by the control profiles stored in the machine control system 15.

If adaptation of the spacing a of the inkjet head 4 from the jetting cylinder 10 is to be performed in order to adapt to a sheet thickness d, this is likewise possible with the embodiment of the inkjet head 4 illustrated in FIG. 3. For this purpose, as a rule a very small rotational movement of the servomotor 19 and therefore of the cam disk 20 is sufficient.

Figure 4A:
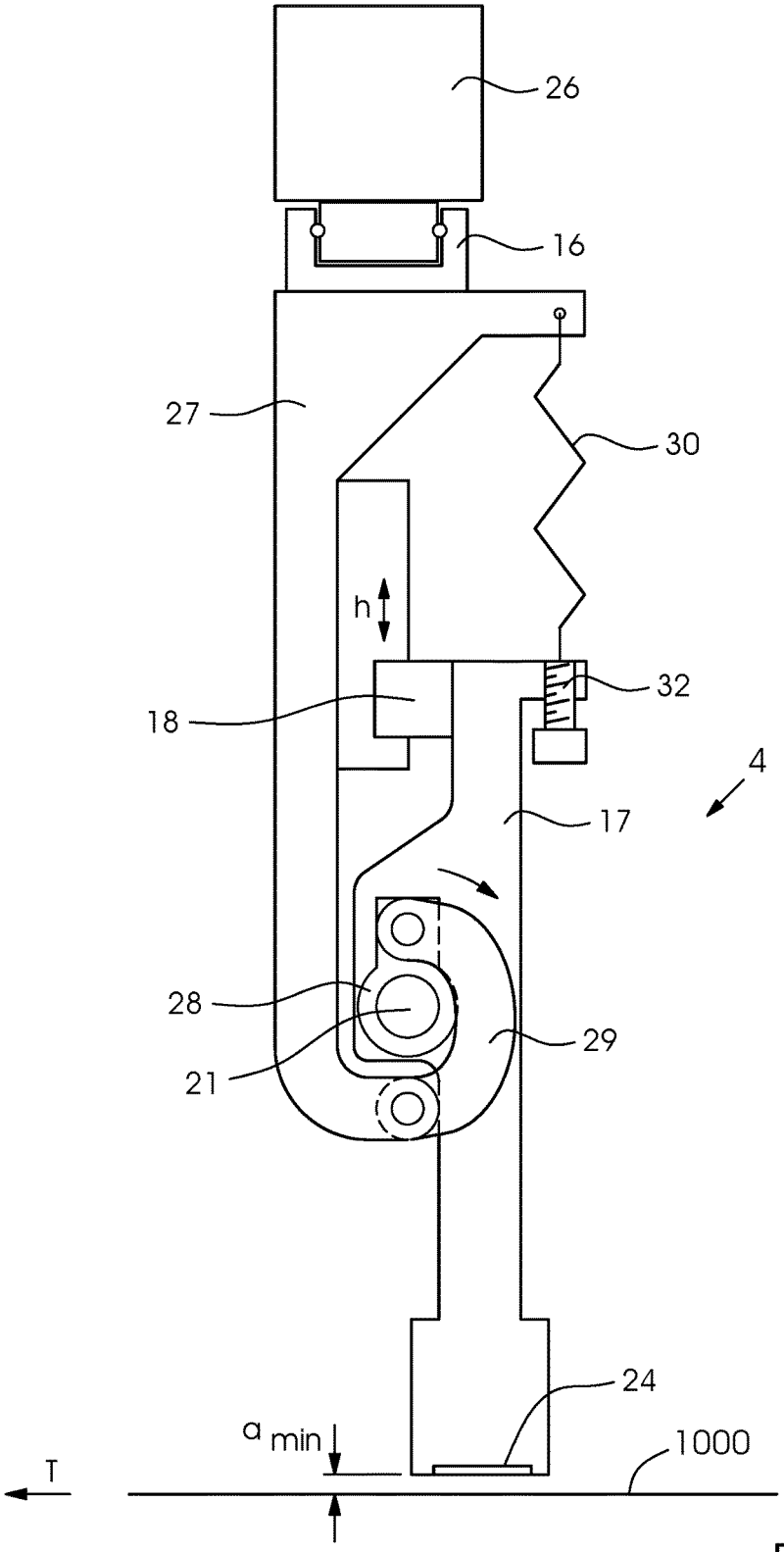
FIGS. 4A-4C show the raising of a print head with a spring system.
Figure 4B:
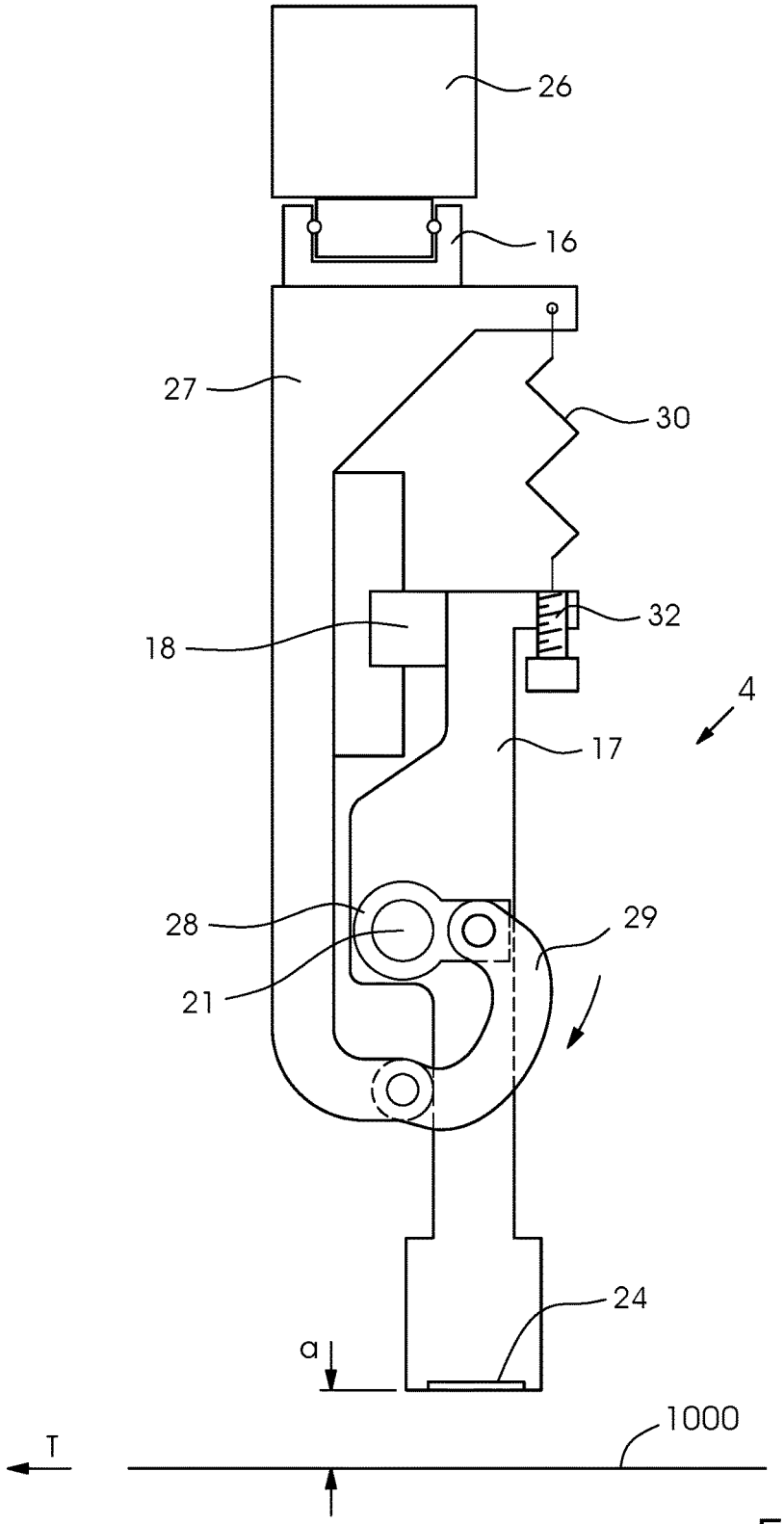
Figure 4C:
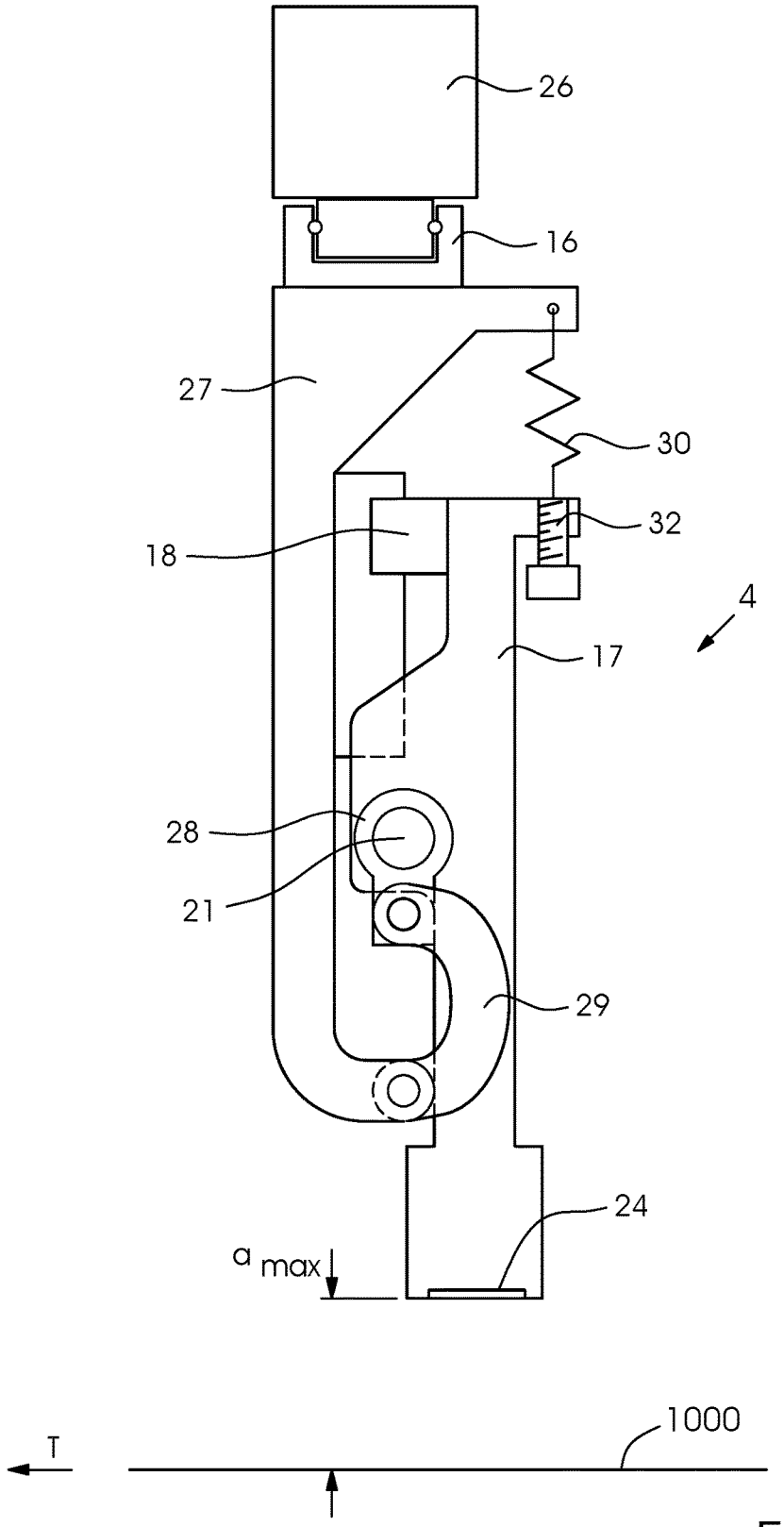

Referring now to FIGS. 4A, 4B and 4C, there is illustrated an alternative embodiment of the suspension of the inkjet head 4. The nozzle bar 24 of an inkjet head 4 is fitted to an end of an integrated print bar by a print head carrier 17. The print head carrier 17 is connected via a coupler mechanism 28, 29 to a carrier 27; the carrier 27 is in turn mounted by means of a horizontal linear guide 16 on a support beam 26 of the machine frame. In order to set the spacing a of a nozzle plate 24 from a sheet 1000 transported in the transport direction T, a setting movement h is carried out and the print head carrier 17 is moved relative to the carrier 27. For this purpose, a drive (not illustrated) having a drive shaft 21 is provided. The rotational movement of this drive shaft 21 is converted by the coupler mechanism 28, 29 with lever 28 and coupler 29 into a vertical movement h. In the illustration of FIG. 4A, the lever 28 is not deflected, is therefore in its zero degree position (0°), and the spacing a between nozzle plate 24 and sheet 1000 is minimal. The coupler mechanism 28, 29 ensures that the print head 4 cannot be lowered deeper. A collision of the nozzle plate 24 with a transport element 10 is thus reliably prevented. By means of appropriate actuation of the drive with its drive shaft 21, the print head carrier 17 with its nozzle plate 24 can be raised in the direction h, as emerges from FIGS. 4B and 4C. In the illustration of FIG. 4B, the lever 28 has been rotated as far as its central 90° position, and the spacing a has thus been enlarged. In the illustration of FIG. 4C, the lever 28 has been rotated as far as its stop position of 180°, the maximum spacing a being reached. In order to prevent the print head carrier 17 with its nozzle plate 24 being lowered or raised inadvertently and abruptly, for example, in the case of a fault or a defect of the drive or else in the case of a power failure, a spring system is provided which, in the embodiment according to FIGS. 4A to 4C, has a tension spring 30, which braces the print head carrier 17 with a carrier 27. In order to be able to adjust the action in the tension spring 30, a spring tensioner 32 is provided as setting device. The spring action is set such that the sum of spring force and self-locking of the drive compensates for the weight of the inkjet head and is sufficient to keep the print head carrier 17 in its position.

Figure 5:
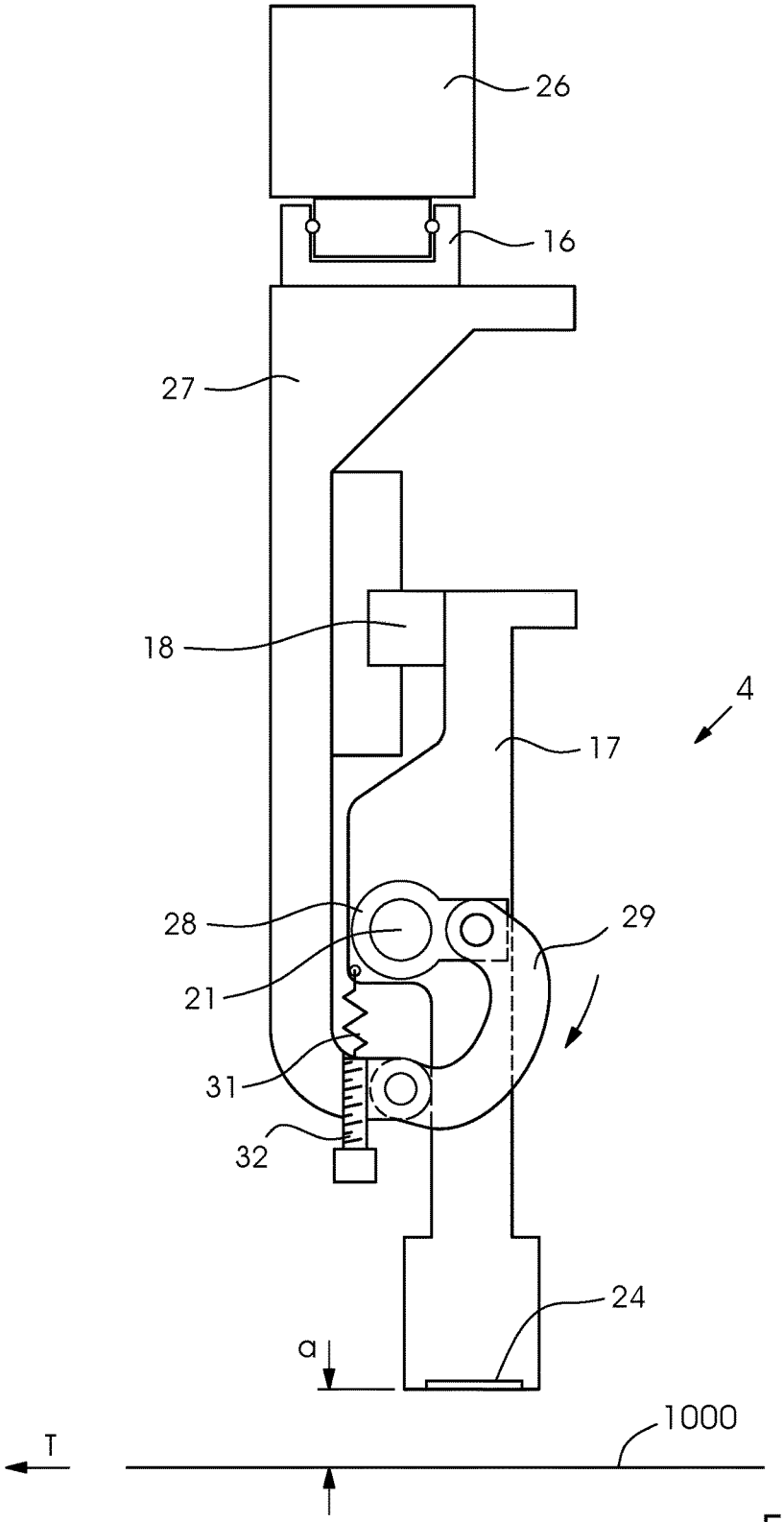
FIG. 5 shows an alternative embodiment of a print head.

In the alternative design variant according to FIG. 5, the spring system has a compression spring 31.

The following is a summary list of reference numerals and the corresponding structure used in the above description of the invention:

1 Feeder
2 Printing unit
3 Deliverer
4 Inkjet heads
4.1 First inkjet head
4.2 Second inkjet head
4.3 Third inkjet head
4.4 Fourth inkjet head
5 Transfer cylinder
6 Drive
10 Impression cylinder (jetting cylinder) (transport element)
11 Sheet-holding region or sheet support surface
12 Channel
13 Gripper
14 Sensor/camera
15 Machine control system
16 Linear guide
17 Integrated print bar with print head carrier
18 Linear guide
19 Drive (servomotor)
20 Cam
21 Drive shaft
22 Cam roller
23 Support roller
24 Nozzle bar
25 Ejector drum
26 Support beam
27 Carrier
28 Lever
29 Coupler
30 Tension spring
31 Compression spring
32 Spring tensioner as setting device
100 Sheet-fed printing machine
1000 Sheet
1001 Defect/fault
a Spacing
d Sheet thickness
h Lifting movement
T Transport direction

The invention claimed is:

1. A method for avoiding collisions of sheets with inkjet heads in a printing machine, the method comprising:
- providing a transport element being a sheet-carrying cylinder formed with a plurality of sheet support surfaces and channels arranged there between;
- transporting sheets on the transport element past a plurality of inkjet heads disposed above the transport element for printing the sheets;
- monitoring the position of a respective sheet upstream of the inkjet heads in a transport direction;
- evaluating a measured result from the position monitoring for detecting a defective sheet;
- when a defective sheet is detected, raising a respective inkjet head before the defective sheet reaches the inkjet head; and
- raising and lowering a respective inkjet head while a channel adjoining a defective sheet is passing the respective inkjet head.

2. The method for avoiding collisions according to claim 1, which comprises:
- selectively raising and lowering each respective inkjet head with at least one actuator; and
- following the raising step, lowering a respective inkjet head in each case after the defective sheet has passed the inkjet head.

3. The method for avoiding collisions according to claim 1, which further comprises, following the raising step: lowering a respective inkjet head while the defective sheet is still passing the inkjet head, wherein the respective inkjet head had been raised in the raising step to such an extent that a collision would also be avoided during the lowering.

4. The method for avoiding collisions according to claim 1, wherein the evaluating step comprises determining defect sizes and the raising step comprises defining a travel distance for raising the inkjet head based on the defect sizes.

5. The method for avoiding collisions according to claim 4, wherein the determining step comprises classifying the defect sizes.

6. The method for avoiding collisions according to claim 4, which comprises lifting and lowering the inkjet head with an actuator being a servomotor driven by a machine control system by way of an oscillation-optimized control profile.

7. The method for avoiding collisions according to claim 1, wherein the transport element is a jetting cylinder.

8. A method for avoiding collisions of sheets with inkjet heads in a printing machine, the method comprising:
- transporting sheets on a transport element past a plurality of inkjet heads disposed above the transport element for printing the sheets;
- monitoring the position of a respective sheet upstream of the inkjet heads in a transport direction;

evaluating a measured result from the position monitoring for detecting a defective sheet and determining defect sizes;

when a defective sheet is detected, raising a respective inkjet head before the defective sheet reaches the inkjet head, and defining a travel distance for raising the inkjet head based on the defect sizes.

9. A method for actuator-based lifting movement of an inkjet head, the method comprising:

providing an actuator assigned to the inkjet head and a machine control system for activating the actuator;

implementing an oscillation-optimized and inkjet-printing-optimized movement profile, in order to limit oscillations of the inkjet head and to limit pressure fluctuations in the ink supply of the inkjet head, wherein a control profile is stored in the machine control system; and selectively lifting the inkjet head by activating the actuator assigned to the inkjet head with the machine control system in accordance with the control profile.

10. The method according to claim 9, wherein a plurality of control profiles for a family of movement profiles are stored, and wherein respective movement profile maintains defined maximum acceleration limiting values.

11. A device for actuator-based lifting movement of an inkjet head in order to change the spacing of the inkjet head from a printing material transport path of printing materials, the device comprising:

an actuator;

a mechanism for converting a rotational drive movement of the actuator into a translational movement of the inkjet head, said mechanism being a coupler mechanism with a coupler, a lever and a drive shaft; and a compensation system for compensating for a weight of the inkjet head and for bracing the inkjet head against a machine frame of the device.

12. The device for actuator-based lifting movement according to claim 11, wherein said compensation system for compensating for the weight of the inkjet head is a spring system having at least one tension spring or at least one compression spring, and/or said spring system has a setting device for adjusting a spring tension.

13. The method for avoiding collisions according to claim 8, wherein the transport element is a sheet-carrying cylinder formed with a plurality of sheet support surfaces and channels arranged there between, and the method further comprises raising and lowering a respective inkjet head while a channel adjoining a defective sheet is passing the respective inkjet head.

* * * * *